US006328537B1

(12) United States Patent
Eisenbacher et al.

(10) Patent No.: US 6,328,537 B1
(45) Date of Patent: Dec. 11, 2001

(54) RADIAL PISTON PUMP

(75) Inventors: Egon Eisenbacher, Karlstadt; Franz Pawellek, Hafenlohr; Johann Schneider, Lohr; Manfred Unger, Kleinostheim, all of (DE)

(73) Assignee: Hydraulik-Ring GmbH (DE)

( * ) Notice: Subject to any disclaimer, the term of this patent is extended or adjusted under 35 U.S.C. 154(b) by 0 days.

(21) Appl. No.: 09/446,493

(22) PCT Filed: Jun. 17, 1998

(86) PCT No.: PCT/DE98/01646

§ 371 Date: May 18, 2000

§ 102(e) Date: May 18, 2000

(87) PCT Pub. No.: WO98/58171

PCT Pub. Date: Dec. 23, 1998

(30) Foreign Application Priority Data

Jun. 17, 1997 (DE) ..... 197 25 565

(51) Int. Cl.[7] ..... F04B 1/04
(52) U.S. Cl. ..... 417/273; 417/366; 277/399
(58) Field of Search ..... 417/273, 366; 277/399

(56) References Cited

U.S. PATENT DOCUMENTS 3,945,766 * 3/1976 Gelon ..... 417/273
4,913,628 * 4/1990 Samland et al. ..... 417/273
4,966,530 * 10/1990 McCusker et al. ..... 417/273
4,983,100 * 1/1991 Budecker ..... 417/273 X
5,354,183 * 10/1994 Eisenbacher et al. ..... 417/366

FOREIGN PATENT DOCUMENTS 26 51 885-A1 * 5/1978 (DE) .
43 05 791-A1 * 9/1994 (DE) .
1 524 656 * 9/1978 (GB) .
2 309 270-A * 7/1997 (GB) .

* cited by examiner

*Primary Examiner*—Charles G. Freay
*Assistant Examiner*—David J. Torrente
(74) *Attorney, Agent, or Firm*—R. W. Becker & Associates; R. W. Becker

(57) ABSTRACT

A radial-piston pump has at least one delivery unit with a delivery element. A pump casing is provided which has a first accommodation space for a medium to be delivered and a second accommodation space for a lubricant, the pump casing further has an eccentric side and a casing side. A separating device separates the first accommodation space and the second accommodation space from one another. The separating device has a first sealing element disposed fluid-tightly on the casing side of the pump casing and a second sealing element disposed on the eccentric side and connected fluid-tightly with the first sealing element. A shaft bearing configuration is disposed in the pump casing and supports an input shaft having an end portion. An eccentric element is disposed on the end portion of the input shaft. The second sealing element is disposed so as to be capable of sliding in a circumferential direction of the eccentric element. In this manner, a rotary motion of the input shaft is converted by the eccentric element into a radial motion of the delivery element of the delivery unit.

15 Claims, 6 Drawing Sheets

RADIAL PISTON PUMP

BACKGROUND OF THE INVENTION

The invention relates to a radial-piston pump, in particular a high-pressure gasoline pump. The radial-piston pump has at least one delivery unit and a separating device that separates a first accommodation space for a medium to be delivered and a second accommodation space for a lubricant from one another. A sealing element is provided on a casing side and a further sealing element is provided on an eccentric side that is fluid-tightly connected to the sealing element.

Radial-piston pumps of this kind, which are known, for example, from DE 43 05 791 A1, are used as fuel pumps for internal combustion engines. Fuel is delivered by means of at least one radial piston, which is actuated by an eccentric of a shaft. It is customary for three such radial pistons to be distributed uniformly around the outer circumference of the eccentric shaft. Each of the radial pistons rests via a sliding shoe and an eccentric ring on the eccentric shaft. The eccentric ring is supported rotatably on the eccentric shaft via a sliding-contact bearing and ensures reliable guidance of the sliding shoe with minimum frictional losses. The cylinders for accommodating the radial pistons are arranged in the pump casing and are each provided with an intake valve and a delivery valve, via which the fuel can be drawn in from the crank space and via which the pressurized fuel can be passed to the internal combustion engine.

The known radial-piston pump is lubricated by means of a separate lubricant circuit in which the lubricant is passed to the shaft bearings and the sliding-contact bearing of the eccentric ring through an axial hole in the eccentric shaft.

In pumps of this kind, there is a constant need to ensure that the lubricant circuit is sealed off from the fuel circuit, in particular from the crank space of the eccentric, thus eliminating the possibility of leakage flow, which would impair either the efficiency of the pump or have a negative effect on lubrication.

In the known pump, this is prevented by a comparatively complex construction with spring-loaded thrust washers which, on the one hand, are used for axial guidance of the eccentric ring and, on the other hand, act on seals which separate the crank space from the lubricant circuit.

For delivery of volatile fuels such as gasoline, special measures are required to suppress the formation of vapor bubbles over the entire speed and temperature range of the engine. Since the fuels generally have a lower viscosity than diesel, relatively small component tolerances are required, especially in the sealing region, to prevent leakage flows. However, such small component tolerances necessitate a considerable outlay in terms of manufacture and this increases the production costs for the pump.

DE-A 197 01 392 discloses a radial-piston pump in which a cam is situated on the input shaft in an approximately central position in a space which is separated by an axially arranged separating element into a working-fluid zone and a lubricant zone. Since the flexible separating element is therefore very long in the axial direction, the outlay in terms of manufacture is likewise high in the case of this radial-piston pump.

International application WO 95/33924 relates to a piston pump in which a lubricant space provided at the circumference of the eccentric and a lubricant space in the vicinity of the input-shaft bearing portion are connected by a lubricant passage in the input shaft. In this piston pump, the outlay on equipment required to seal off the lubricant spaces is high by its very arrangement.

DE-A 196 37 646 discloses a radial-piston pump in a hydropump unit, in which pump a rod-shaped eccentric element is mounted eccentrically in the input shaft at one end and in a manner fixed relative to the casing at the other end, with the result that it moves within the envelope surface of a cone as the input shaft rotates. The bearing portions on the rod-shaped eccentric element are not lubricated reliably and independently of the working-fluid circuit.

Given this situation, the object on which the invention is based is to provide a radial-piston pump in which leakage flows can be reduced with a minimum outlay in terms of equipment.

SUMMARY OF THE INVENTION

With the foregoing and other objects in view there is provided, in accordance with the invention, a radial-piston pump, including:

at least one delivery unit having a delivery element;

a pump casing having a first accommodation space for a medium to be delivered and a second accommodation space for a lubricant, the pump casing further having an eccentric side and a casing side;

a separating device separating the first accommodation space for the medium to be delivered and the second accommodation space for a lubricant from one another, the separating device including a first sealing element disposed fluid-tightly on the casing side of the pump casing and a second sealing element disposed on the eccentric side and connected fluid-tightly with the first sealing element;

a shaft bearing configuration disposed in the pump casing;

an input shaft having an end portion and supported by the shaft bearing configuration; and an eccentric element disposed on the end portion of the input shaft, the second sealing element is disposed so as to be capable of sliding in a circumferential direction of the eccentric element, a rotary motion of the input shaft being convertible by the eccentric element into a radial motion of the delivery element of the delivery unit.

A radial-piston pump according to the invention thus has a separating device with a sealing element on the casing side and a sealing element on the eccentric side which are connected fluid tightly to one another, the separating device separating accommodation spaces for medium to be delivered and, respectively, working fluid and lubricant. A rotary motion is imparted to an eccentric element by an input shaft and said element transmits this rotary motion, giving rise to a radial motion at a delivery element, which can be a sliding shoe. In this arrangement, the sealing element on the eccentric side is capable of sliding in the circumferential direction of the eccentric element, and the sealing element on the casing side is arranged fluid tightly on the pump casing. The eccentric element is arranged on an end portion of the input shaft or eccentric shaft, and the input shaft is supported in the pump casing by a shaft bearing arrangement.

Low-loss energy transmission from the eccentric shaft to the sliding shoe is thus provided and, at the same time, the space containing the medium to be delivered is separated effectively from the lubricant space and a long service life for the radial-piston pump is assured.

An orbital motion occurs between the sealing element on the casing side and the sealing element on the eccentric side and this orbital motion is absorbed by the separating device, with the result that the operating parameters are not prejudiced.

In a first embodiment, the eccentric element is in the form of an axial projection on the input shaft, thereby ensuring that the number of components is small.

In a modification of the first embodiment, the sealing element on the casing side and that on the eccentric side slide on one another. This provides a compact radial-piston pump.

According to other modifications of the first embodiment, the sealing element on the eccentric side is of cap-shaped design, allowing the circumference of the eccentric element to be sealed off with just one component.

It is furthermore advantageous if this cap-shaped sealing element is a thin-walled component in the form of a sliding-contact bearing or the outer race of a rolling-contact bearing. This makes it possible to increase the efficiency of the radial-piston pump while, at the same time, ensuring good sealing.

A contact-pressure device at the base of the sealing element on the eccentric side allows the sealing element on the eccentric side to be preloaded against the eccentric element, thereby allowing energy losses due to play of the sealing element on the eccentric side to be reduced.

According to a second embodiment of the present invention, the eccentric element takes the form of an axial depression. This allows the length of the input shaft to be reduced and thus makes it possible to limit troublesome noise in bearings and wear of the bearings.

Given such a configuration, the sealing element on the eccentric side is preferably a coupling element which extends in the axial direction, which transmits motion from the input shaft to the sliding shoe and the end portion of which is supported rotatably in the axial depression. The medium to be delivered and the lubricant are thus separated in linear form by means of a flexible separating element, and the effects of axial forces can thereby be absorbed more effectively.

If this coupling element is guided on the pump casing, accuracy in the manufacture of the bearing arrangement can be reduced.

If that end portion of the coupling element which is remote from the axial depression is supported by the pump casing, the eccentricity is greater than the stroke of the sliding shoe.

If the coupling element is supported centrally on the pump casing, the stroke of the delivery element can be adjusted as a function of lever ratios of the coupling element.

A sealing element between the sealing element on the eccentric side and the sealing element on the casing side is a particularly effective means of absorbing the relative motion between the sealing element and axial forces between the space for accommodating the medium to be delivered and the space for accommodating the lubricant.

The flexible element can rest leak tightly against the coupling element, which presupposes a corresponding configuration of the profile of the flexible element, or can be secured on it, in which case the effect of fatigue of the material as a cause of faults is reduced.

Preventing rotation of the coupling element by means of an appropriate mechanical device counteracts energy losses in the radial-piston pump.

Supporting the eccentric shaft at one end and forming, at the projecting free end of the eccentric shaft, a cap-shaped eccentric ring which covers the free end of the eccentric shaft and the annular end faces of which act on a shaft seal formed between the shaft bearing arrangement and the eccentric allows the lubricant circuit to be separated reliably from the circuit containing the medium to be delivered, in particular from the medium to be delivered in the crankcase. In this design, the cap-shaped eccentric ring acts practically as part of the shaft seal and contributes to surrounding the free end portion of the eccentric shaft in a sealing manner.

Supporting the shaft at one end considerably simplifies the installation of the eccentric shaft in comparison with conventional solutions having split bearings arranged on both sides of the eccentric, and assembly costs are thus reduced in comparison with the previously known solution.

It is possible for the cap-shaped eccentric ring to be pressed against the shaft seal exclusively by the fluid pressure in the crank space. However, the sealing effect can be further enhanced if the base of the eccentric ring is acted upon by a contact-pressure device which presses the eccentric ring against the seal.

It is advantageous if this contact-pressure device has a pressure ring, the angle of which can be adjusted and which is preloaded against the cap-shaped eccentric ring by a preloading spring.

The shaft-sealing device employed in the design according to the invention preferably has a slip ring, one sliding surface of which is acted upon by the pressure ring and by means of which a sealing ring is pressed against the shaft and the shaft bearing arrangement.

A friction-reducing insert made, for example, of Teflon can be provided in the friction face of the slip ring to reduce the friction between the latter and the cap-shaped eccentric ring.

Support for the shaft at one end is preferably provided by a grease-packed rolling-contact bearing arrangement.

To prevent oil ingress from outside, another sealing device is arranged in the region between the input-side end portion of the eccentric shaft and the shaft bearing.

It is advantageous to provide a sliding-contact bearing between the eccentric ring and the eccentric of the eccentric shaft.

Assembly of the radial-piston pump is particularly simple if the shaft bearing arrangement is arranged in the pump pot of the casing.

Other developments of the invention form the subject matter of the other subclaims.

BRIEF DESCRIPTION OF THE DRAWING

A preferred illustrative embodiment of the invention is explained below with reference to the figures, of which.

DESCRIPTION OF PREFERRED EMBODIMENTS

Figure 1:
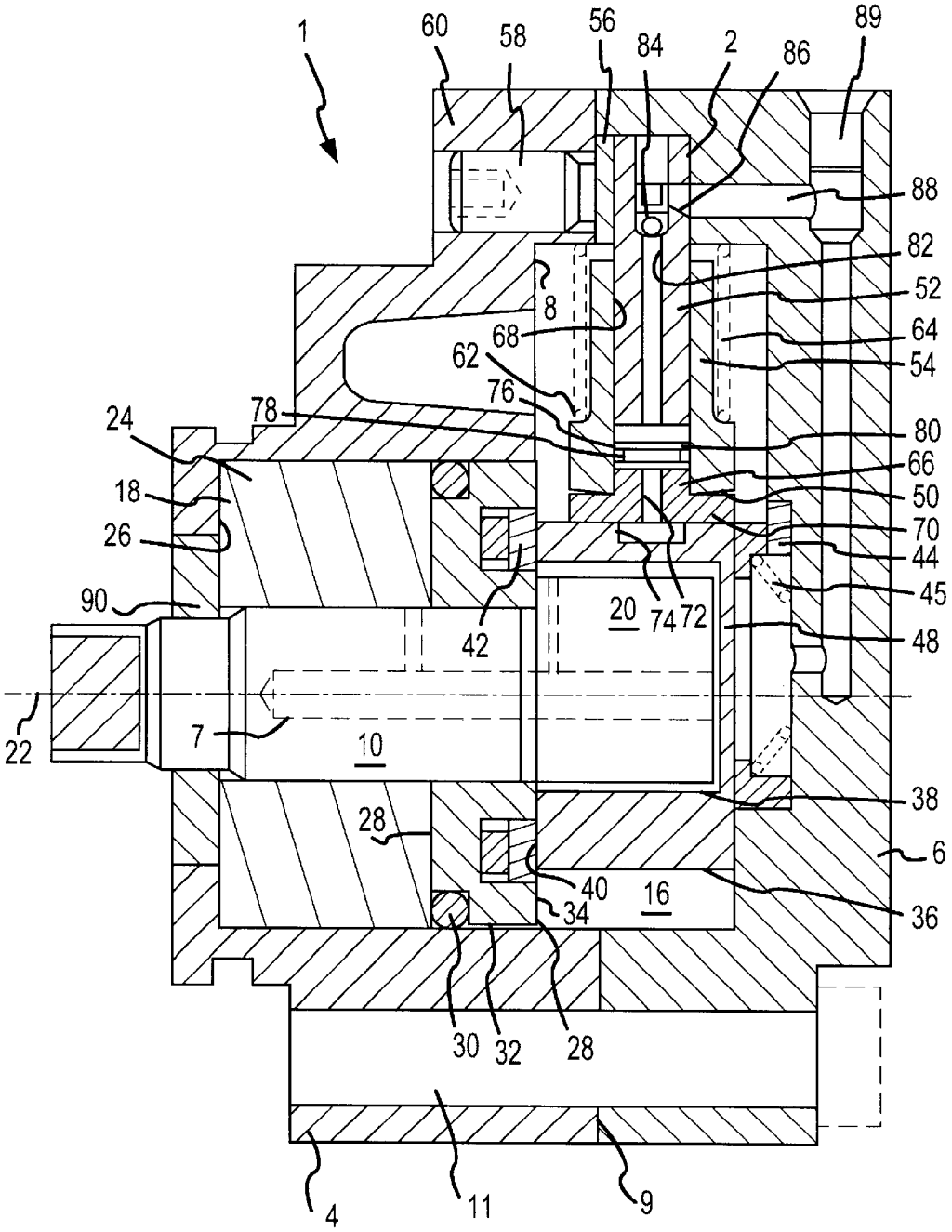
FIG. 1 is a section through a first illustrative embodiment of the radial-piston pump according to the invention.

FIG. 1 is a section through a radial-piston pump 1 in accordance with the first illustrative embodiment, the section being taken in such a way that only one delivery unit 2 is visible. The components of the radial-piston pump according to the invention which are common to all the illustrative embodiments of the present invention will now be described below with reference to FIG. 1.

The radial-piston pump 1 shown in FIG. 1 has a pump casing with a casing pot 4, which is closed by a casing cover, referred to below as casing flange 6. Formed in the pump casing is a multiplicity, for example three, cylindrical accommodation spaces 8, in each of which one of the delivery units 2 is accommodated. Arranged in the parting plane between the casing pot 4 and the casing flange 6 is an encircling gas tight seal 9, which is similar in design to a cylinder head gasket. The two parts of the casing are screwed together by means of clamping screws 11.

The delivery units 2 are driven by means of an eccentric shaft 10 mounted in the casing pot 4. The shaft bearings are lubricated and cooled by means of a lubricant circuit 7 illustrated in broken lines.

The medium to be delivered, in the present case gasoline, is fed at a predetermined feed pressure (1 to 3 bar), via an inlet port (not shown), into a crank space 16 formed between the casing pot 4 and the casing flange 6 and, after pressurization, is passed via an outlet port (likewise not shown) to the internal combustion engine.

However, the present invention is not limited to the separation of the medium to be delivered and the lubricant. On the contrary, any desired fluids can be separated, it being possible for two fluids of the same type at, for example, different pressures and/or different temperatures to be present.

The eccentric shaft 10 has an eccentric element 20, the center of which is offset relative to the axis of rotation 22 of the eccentric shaft 10 by the eccentricity e.

In contrast to the prior art cited at the outset, the eccentric shaft 10 in the illustrative embodiments according to the invention is supported at only one end, a grease-packed rolling-contact bearing 18 being secured in an axial hole 24 in the casing pot 4. The axial hole 24 is provided with a radial shoulder 26, against which that end portion of the rolling-contact bearing 18 which is on the left in FIG. 1 is supported.

The rotary motion of the eccentric shaft 10 is converted into an orbital motion of an eccentric ring 36 by a transmission device described in greater detail below. The term orbital motion is here taken to mean motion in a circle without a change in orientation in a plan view of the circle. In that end portion which is at the top in the figure, the eccentric ring 36 is flattened, the flat extending approximately perpendicular to the plane of the drawing in the figure. During the rotation of the eccentric shaft 10, the flat maintains its orientation relative to the delivery unit 2, thus providing a defined contact surface. Due to the tumbling motion of the eccentric element 20, the eccentric ring 36 executes a compensating motion during this process, resulting in a relative displacement approximately perpendicular to the plane of the drawing between the delivery unit 2 and the flat. As regards further details of the delivery unit 2, attention is drawn to the statements below.

The casing pot 4 and the casing flange 6 delimit the crank space 16, from which the accommodation spaces 8 for the delivery units 2 extend in the axial direction. Each of these delivery units 2 has a fixed, upright, cylindrical piston 52 which is secured radially in the parting plane between the casing pot 4 and the casing flange 6 and on which a cylinder 54, which can be moved in an oscillating manner, is guided. The piston 52 is secured by means of a clamping device with a clamping piece 56 which can be fixed by means of a clamping screw 58. The latter passes through a flange 60 of the casing pot 4. On its circumference, the cylinder 54 guided on the piston 52 has an annular end face 62 on which there acts a compression spring 64, the other end of which is supported by means of a spring plate mounted on the casing. The cylinder 54 is preloaded in the direction of the outer circumference of the eccentric ring 36 by means of the compression spring 64. Other suitable devices for clamping the piston 52 can be used instead of the clamping screw 58, it being possible, for example, to use leaf-spring and elastomer elements. Provided in the parting plane are receptacles, which are formed with high accuracy and allow the piston 52 to be located in a simple manner. The cylindrical piston can be provided with an ultra fine finish in a very simple manner, e.g. by centerless grinding. Some other piston shape can be used instead of the cylindrical piston 52, e.g. a piston with a piston foot, as illustrated in the parallel application P . . . , (our ref.: MA7214) (Radial-piston pump) of the applicant.

The sliding shoe 50 has an axially extending guide stub 66 which projects into the cylinder bore 68 surrounding the fixed piston 52. Adjoining the guide stub 66 is a guide flange 70 of the sliding shoe 50, this guide flange being extended radially relative to the guide stub 66. The cylinder 54 rests on that annular end face of the guide flange 70 which faces away from the eccentric ring 36. The sliding shoe 50 has a central through hole 72 which opens into a tangential slot 74 in the eccentric ring 36.

Secured in the region of the end face of the guide flange 70 is an intake valve, which, in the illustrative embodiment shown, is designed as a plate valve 76, via which the connection to the cylinder space can be opened or closed. The plate of the plate valve 76 is provided with through holes 78 (only one of which is shown) which, with the plate raised from the valve seat, connect the fluid in the cylinder space to the through hole 72. The plate of the plate valve 76 is preloaded into its closed position by a compression spring indicated in the figure. The axial motion of the plate away from the valve seat on the end of the guide stub 66 is limited by a stop ring 80 in the cylinder bore 68. The contact surfaces for the plate on the end of the guide stub 66 and on the stop ring 80 are designed as valve seat surfaces. In the position shown, the fluid connection from the through hole 72 to the piston 52 is closed since the through openings 78 are covered with respect to the eccentric space 16 by virtue of the fact that the plate is resting on the seat surface of the guide stub 66. With the plate raised, the gasoline can flow into the cylinder bores 68 through the through holes 72 and the through holes 78.

Instead of the sliding shoe 50, it is also possible to use a dedicated fastening screw to fix the plate, which is then for its part embodied with a through hole. A corresponding illustrative embodiment is described in the parallel application 197 . . . (our ref.: MA7214) of the applicant, the disclosure of which should be counted as part of the present application.

As can furthermore be seen from the figure, the piston 52 is provided with an axial hole 82, into that end portion of which is at the top in FIG. 1, a pressure valve 84 is screwed. In the illustrative embodiment shown, the pressure valve 84 is embodied as a ball check valve, the spherical valve member 86 of which is preloaded resiliently against a valve seat in the axial hole 82. With the valve member 86 raised, the pressurized gasoline (about 100 bar) can be passed via a connecting passage 88 to a common line (not shown). From there, the pressurized gasoline flows to the outlet port.

The delivery-unit design illustrated in the figure has the advantage that the unit comprising the pressure valve 84, the piston 52, the cylinder 54 and the intake valve 76 can be preassembled and then screwed into the pump casing as a pretested cartridge, thus reducing expenditure on manufacture and assembly to a minimum.

The design described above has the further advantage that the flow paths from the crank space 16 to the cylinder space are very short, thus reducing flow remittances to a minimum.

That part of the connecting passage 88 which is adjacent to the pressure valve 84 is formed approximately axially in the casing flange 6 and opens into a radial hole in the casing flange 6, this hole being sealed off from the outside by sealing plug 89.

Oil ingress from the outside is prevented by another shaft sealing ring 90, which is secured on the input-side end portion of the eccentric shaft 10.

During the intake stroke of the cylinder 54, i.e. during its downward movement out of the position illustrated in FIG. 1, there is a liquid column underneath the plate valve 76 secured in the cylinder 54 and, due to the inertia of this liquid column, it counteracts the downward movement of the plate and hence of the cylinder 54 and thus assists the raising of the plate and the filling of the growing cylinder space, thus allowing filling to take place more rapidly and with less flow resistance.

The compensating movement of the eccentric ring 36 causes swirling of the gasoline in the crank chamber 16, thus ensuring that any gas bubbles which occur in the crank space are swirled around and cannot collect at one point.

The structure of the transmission device in accordance with the first illustrative embodiment of the present invention will now be described below. In this embodiment, the eccentric element 20 is embodied as a radially projecting eccentric.

Provided at that end of the rolling-contact bearing 18 which is remote from the radial shoulder 26 is a shaft-sealing device 28, by means of which the crank space 16 and the other flow paths for the medium to be delivered are sealed off relative to the lubricant circuit 7. The shaft-sealing device 28 has a sealing ring 30 which rests against the inner circumference of the axial hole 24 and against the rolling-contact bearing arrangement 18 and is pressed into its sealing position by means of a slip ring 32. The sliding surface 34 of the latter rests against the annular end face 40 of an eccentric ring 26 of cap-shaped design which is supported on the eccentric 20 of the eccentric shaft 10 by means of a sliding-contact bearing 38.

As can be seen from FIG. 1, the eccentric ring 36 has a cap- or cup-shaped cross section and, in the illustration shown, reaches around the eccentric 20, which forms the freely projecting end of the eccentric shaft 10. The annular end face 40 of the eccentric ring 36 rests against the sealing face 34 of the slip ring 32. To reduce the friction between the annular end face 40 and the sealing face 34, the slip ring 32 can be provided with a friction-reducing insert 42, which is composed of Teflon for example and is pressed resiliently against the annular end face 40 by an O ring.

In the first illustrative embodiment shown, the eccentric ring 36 is preloaded axially onto the slip ring 32 by a contact-pressure device which is formed by a pressure ring 44 which is pressed against the end of a base 48 of the eccentric ring 36 by means of a preloading spring 46. The angle of the pressure ring 44 can be adjusted, allowing it to be adapted precisely to the geometry of the base 48.

In this design, the eccentric ring 36 is thus part of the shaft-sealing device 28 since it presses the slip ring 32 against the sealing ring 30.

In the design chosen, the relative speed of the slip ring 32 and the eccentric ring 36 is comparatively low, with the result that heat transfer to the gasoline due to friction and wear of the sealing faces is minimal.

The eccentric ring 36 is pressed against the slip ring 32 not only by the contact-pressure device but also by the fluid pressure in the crank space 16, which corresponds approximately to the fuel feed pressure present at the inlet port. In theory, the eccentric ring 36 could also be pressed on by means of this feed pressure alone, making it possible, under some circumstances, to dispense with the contact-pressure device (pressure ring 44, preloading spring 46). The design of the eccentric ring 36 reaching around the free end portion of the eccentric shaft 10 and the fluid tight contact of the eccentric ring with the slip ring 32 makes it possible to prevent the gasoline in the crank space 16 from reaching the bearings (sliding-contact bearing 38, rolling-contact bearing 18), thus preventing mixing of the two fluid circuits (lubricant, gasoline).

The design according to the invention in accordance with the first illustrative embodiment is distinguished by the fact that the shaft bearing arrangement is very simple, thus reducing the number of gaps in which leakage flow can occur to a minimum in comparison with the prior art described at the outset. Sealing between the circuit containing the medium to be delivered and the lubricant circuit is accomplished essentially by means of a central shaft-sealing device which is preloaded into its sealing position by the eccentric ring 36. The latter thus has a dual function: to guide the sliding shoe 50 and to subject the shaft-sealing device to pressure. By virtue of the cap-shaped design of the eccentric ring 36, the gasoline cannot pass from the freely projecting end of the eccentric shaft 10 into the lubricant circuit.

Figure 2:
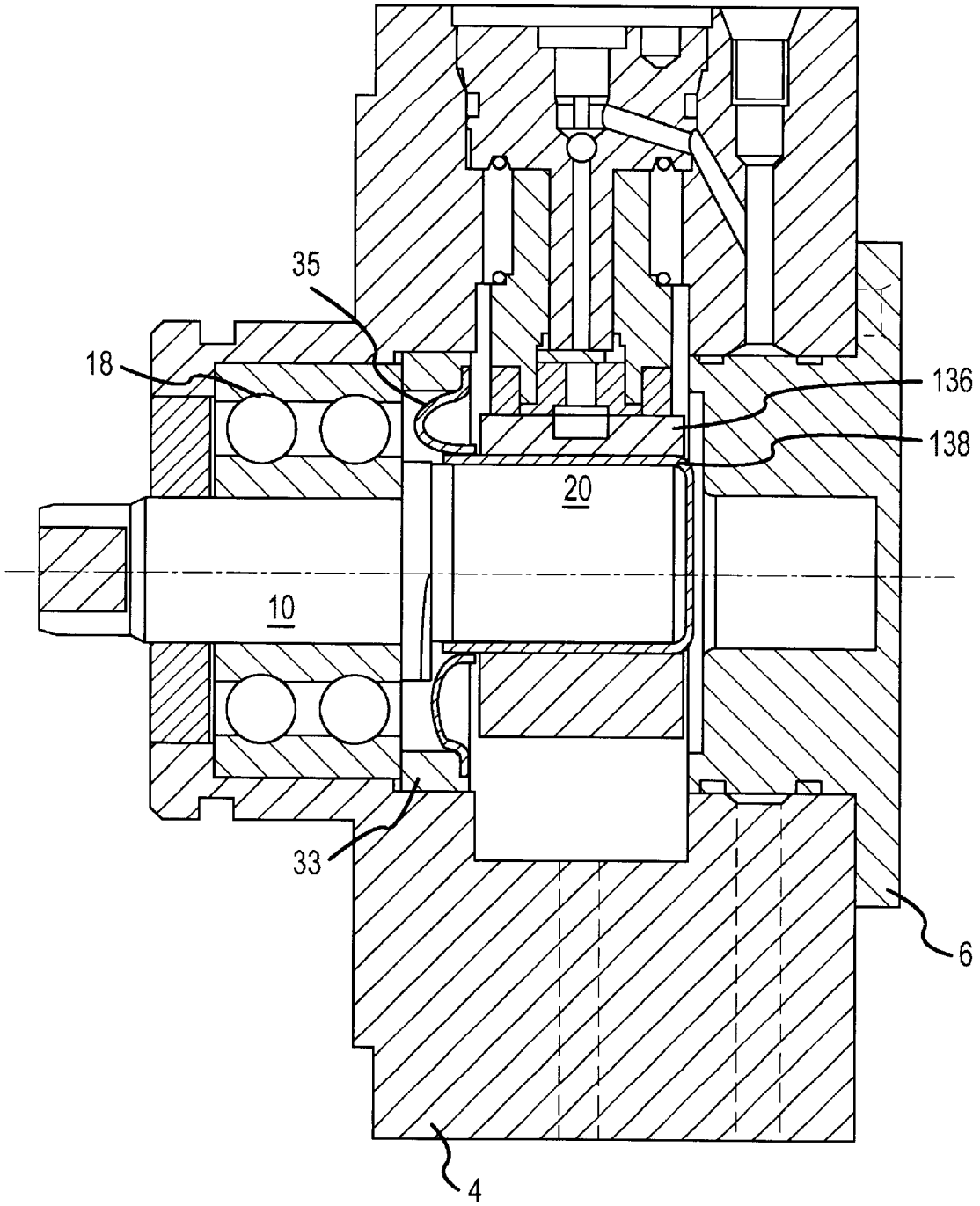
FIG. 2 is a section through a second illustrative embodiment of the radial-piston pump according to the invention.

A second illustrative embodiment of the present invention will now be described with reference to FIG. 2. With the exception of the transmission device, the components of the radial-piston pump of the second illustrative embodiment correspond essentially to those of the radial-piston pump in accordance with the first illustrative embodiment. The design modifications to the casing pot 4 and the casing flange 6, in particular the reduced outside diameter of the casing flange 6, do not have any effect on the way in which the components essential to the invention function and are therefore not explained in detail.

Instead of the shaft-sealing device 28, the sealing ring 30 and the friction-reducing insert 42 in the first illustrative embodiment, the radial-piston pump in accordance with the second illustrative embodiment has a sealing ring 33 and a flexible element 35.

The sealing ring 33 is situated in the inner circumference of the casing pot, adjacent to the shaft bearing arrangement 18 and is of fluid tight design relative to this inner circumferential surface, e.g. by virtue of a press fit. The flexible element 35 is preferably a deformable diaphragm which is connected fluid tightly to the inner circumference of the sealing ring 33. The inner circumferential portion of the flexible element 35 is connected fluid tightly to the outer circumference of a sliding-contact bearing 138. In this arrangement, the flexible element 35 either rests fluid tightly against the sliding-contact bearing 138 or is secured fluid tightly to it.

The sliding-contact bearing 138 is formed by a deep-drawn bush which functions as a sliding-contact bearing, is cap-shaped and thin-walled and is situated on the eccentric element 20, which, as in the first illustrative embodiment, is designed as a projecting eccentric. In the second illustrative embodiment, the eccentric ring 136 is formed as a hollow cylinder and mounted on the sliding-contact bearing 138.

The lubricant circuit and the working fluid are thus separated from one another by the sealing ring 33, the diaphragm 35 and the sliding-contact bearing 138 with little outlay in terms of equipment. At the same time, however, the piston 52 can be driven by the eccentric shaft 10, the eccentric element 20 and hence the inner circumference of the flexible element 35 describing an orbital motion around the eccentric shaft 10. This orbital motion is accommodated by the flexibility of element 35, and the sealing ring 35 thus remains stationary relative to the casing pot 4.

In the second illustrative embodiment, it is also possible, as an option, for a device which is similar to the contact-pressure device 44, 46 of the first illustrative embodiment and ensures the constant position of the sliding-contact bearing 138 to be formed.

Figure 3:
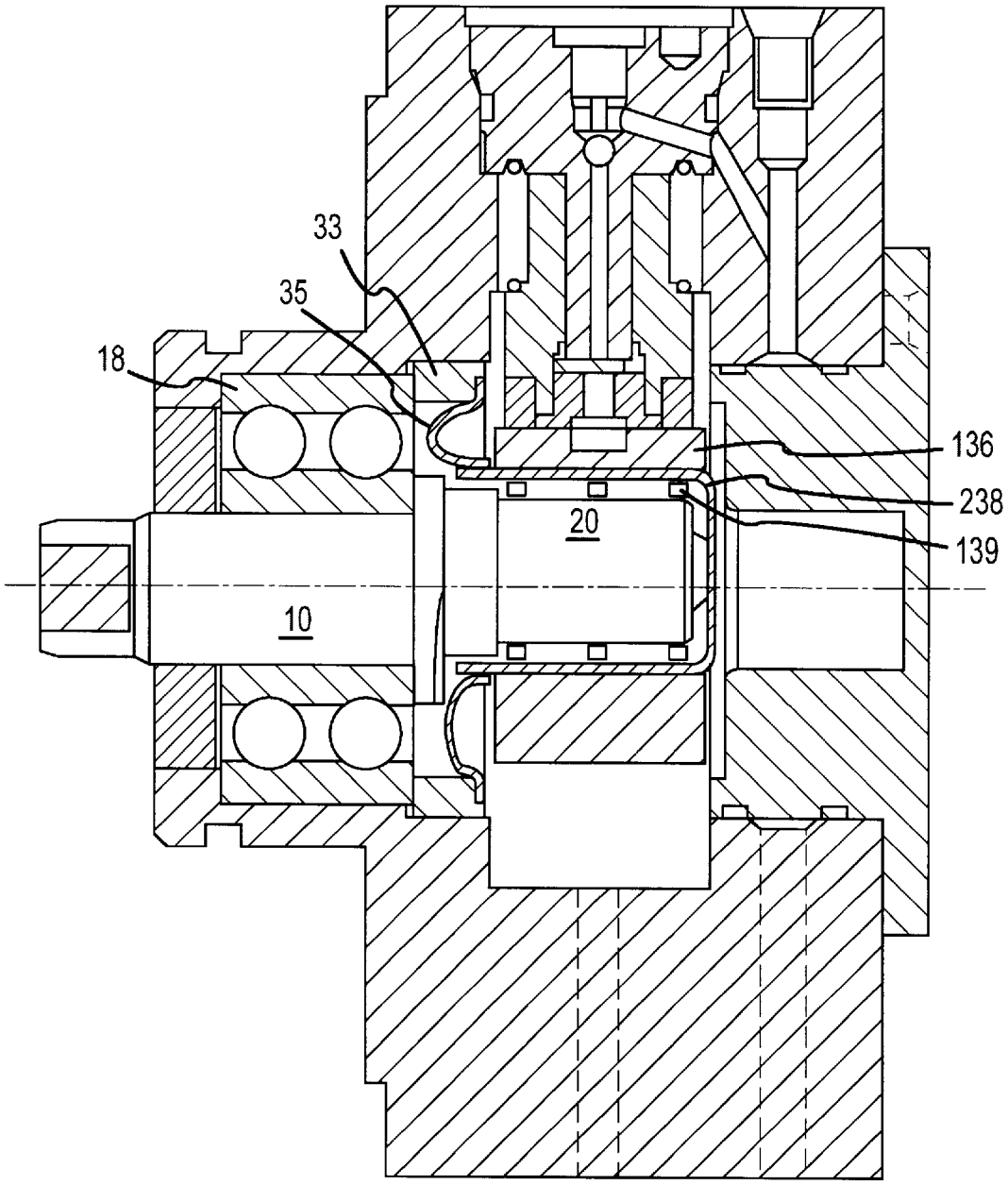
FIG. 3 is a section through a first modification of the second illustrative embodiment of the radial-piston pump according to the invention.

In a modification, shown in FIG. 3, of the third illustrative embodiment, a cap-shaped outer race 238 of a rolling-contact bearing with rolling elements 139 is provided instead of the sliding-contact bearing 138. In this way it is possible to improve the sliding characteristics of the eccentric element 20 and the eccentric ring 136 relative to one another, leading to less wear of the components.

Figure 4:
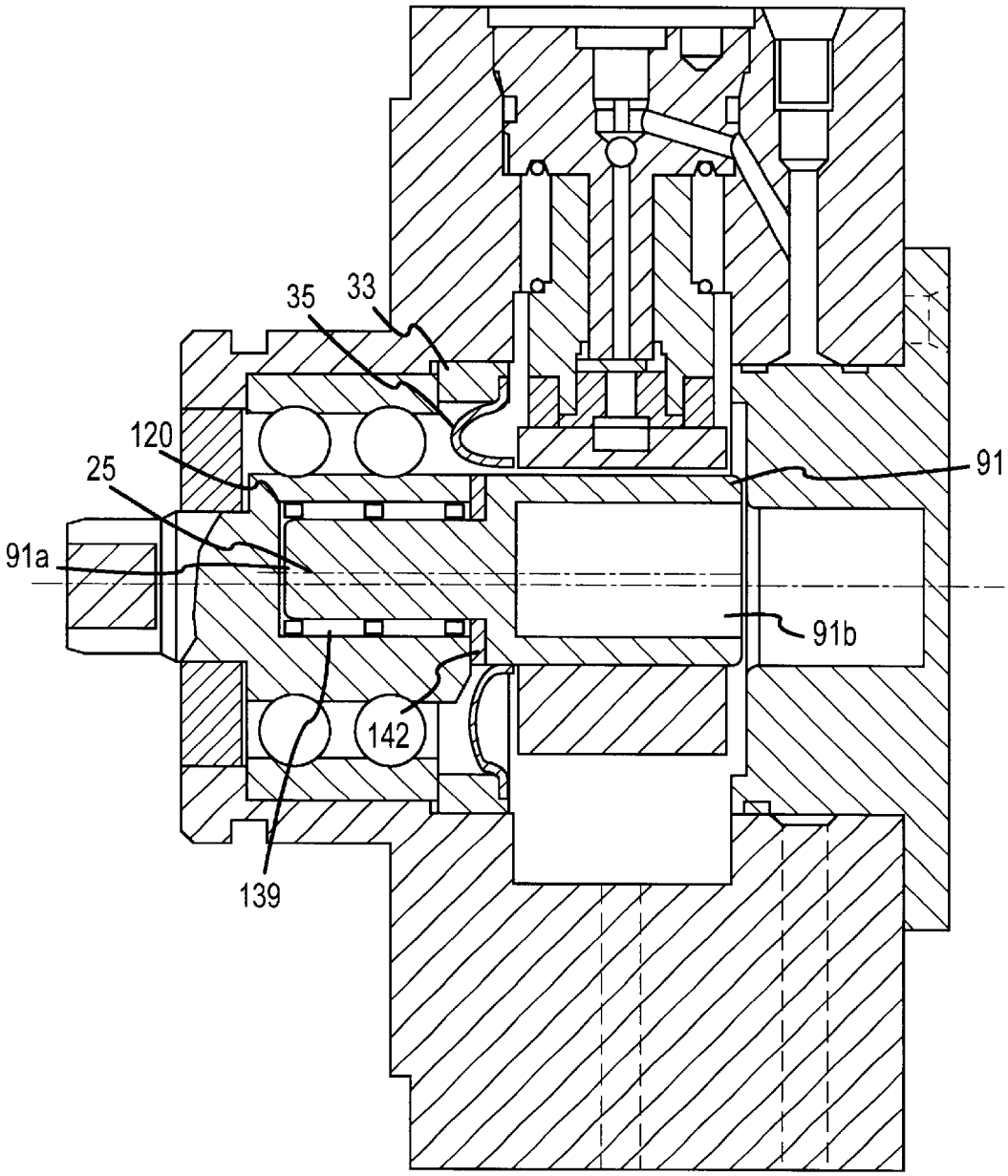
FIG. 4 is a section through a third illustrative embodiment of the radial-piston pump according to the invention.

A radial-piston pump, shown in FIG. 4, in accordance with the third illustrative embodiment differs from the radial-piston pump in accordance with the second illustrative embodiment in the construction of the transmission device.

More precisely, the radial-piston pump in accordance with the third illustrative embodiment has, as the eccentric element on the eccentric shaft 10, an eccentric recess 120, on the inner circumference of which rolling elements 139 of a rolling-contact bearing are provided. These rolling elements 139 support a, preferably solid, cylindrical end portion 91*a* of a coupling element 91.

The coupling element 91 extends in the longitudinal direction of the eccentric shaft 10 and has a center line 25 which is offset relative to the center line 22 of the eccentric shaft 10. That end portion 91*b* which is remote from end portion 91*a* in the axial direction has a larger outside diameter than the end portion 91*a* and is in contact with the eccentric ring. The inner circumference of the flexible element 35 is furthermore also connected fluid tightly to the outside diameter of the coupling element 91.

A device 142 for reducing friction can be provided on the annular surface between the end portions 91*a* and 91*b*.

In the third illustrative embodiment, the eccentric shaft 10 and the coupling element 91 are thus decoupled as regards vibration, and this also reduces noise during the operation of the radial-piston pump according to the invention. Moreover, in comparison with the first illustrative embodiment, assembly of the radial-piston pump is easier since precise positioning of the shaft-sealing device 28 is not necessary.

As shown in FIG. 4, the eccentric shaft 10 can, as an option, be of one-piece design with the inner race of the shaft bearing arrangement 18, thereby making it possible to reduce further the number of components and the space required.

Figure 5:
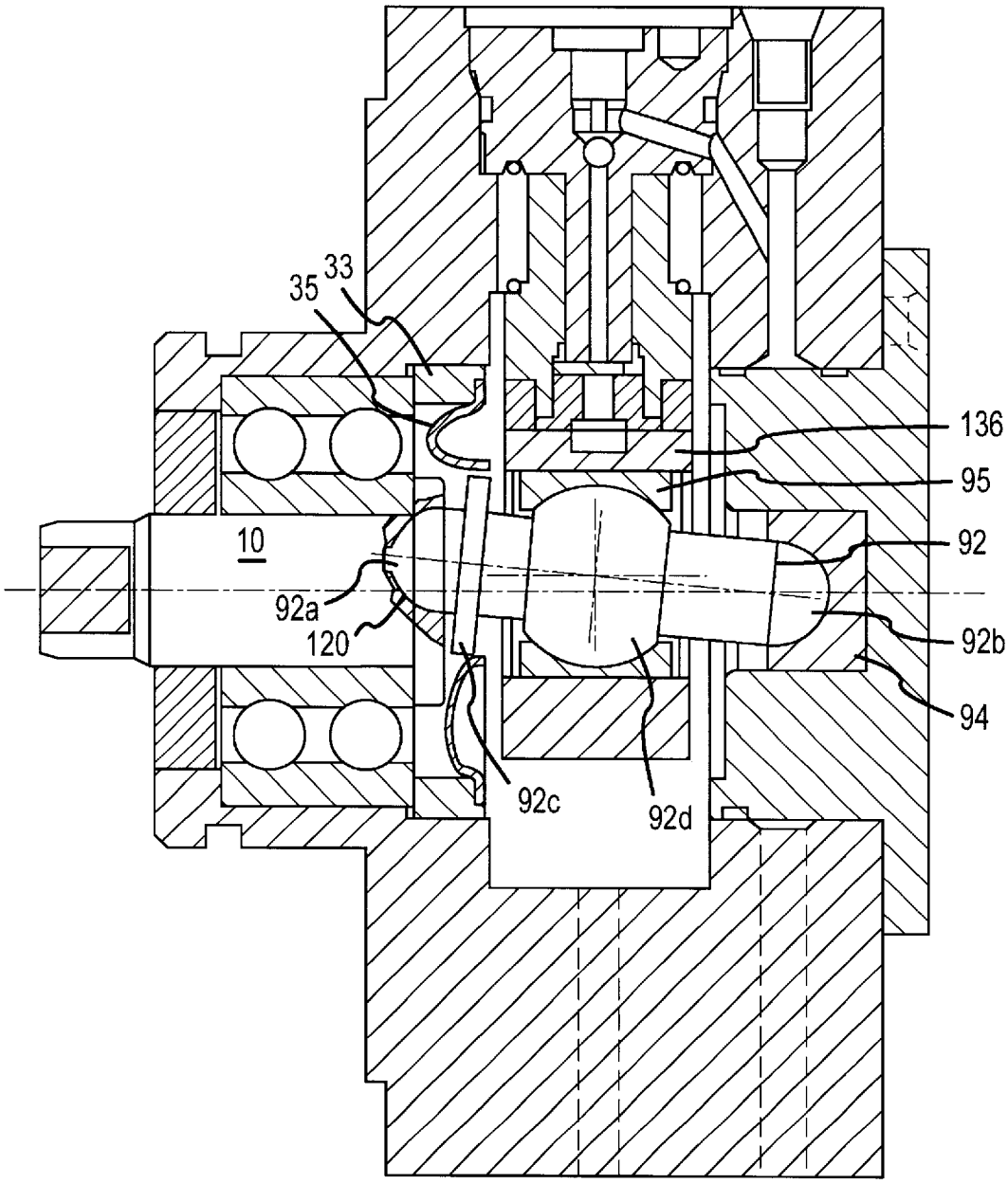
FIG. 5 is a section through a fourth illustrative embodiment of the radial-piston pump according to the invention.

In the fourth illustrative embodiment of the present invention, which is shown in FIG. 5, the eccentric recess 120 in the eccentric shaft 10 is of hemispherical design and accommodates a hemispherical end portion 92*a* of the coupling element 92 in a manner which allows it to slide. With the exception of the transmission device, the construction of this radial-piston pump corresponds to that of the second illustrative embodiment.

The coupling element 92 extends essentially in the axial direction relative to the eccentric shaft 10. That end portion 92*b* which is remote from the end portion 92*a* in the axial direction is situated in a hemispherical guide 94 which is fixed relative to the casing, holds the end portion 92*b* in place and, during an orbital motion of the end portion 92*a* in the eccentric recess 120, guides the coupling element 92 on the envelope surface of a cone.

Formed in the vicinity of the end portion 92*a* is a plate-like projection 92*c* on which an inner portion of the flexible element 35 is secured. As in the second and third illustrative embodiments, the outer portion of the flexible element 35 is secured on the sealing ring 33. Adjoining the projection 92*c* is a spherical bearing portion 92*d*, which is situated in a bearing 95 on the inner circumference of the eccentric ring 136 and, as a result, allows a tilting movement of the eccentric ring 136 and the coupling element 92 relative to one another during an orbital motion of the end portion 92*a* in the eccentric recess 120.

Such a configuration counteracts leaks between the working fluid and the lubricant circuit and, at the same time, reduces the requirements on manufacturing accuracy since the guide 94 fixed relative to the casing does not have to be aligned precisely with the eccentric shaft 10 and yet increased wear, lower efficiency and troublesome noise do not result.

Figure 6:
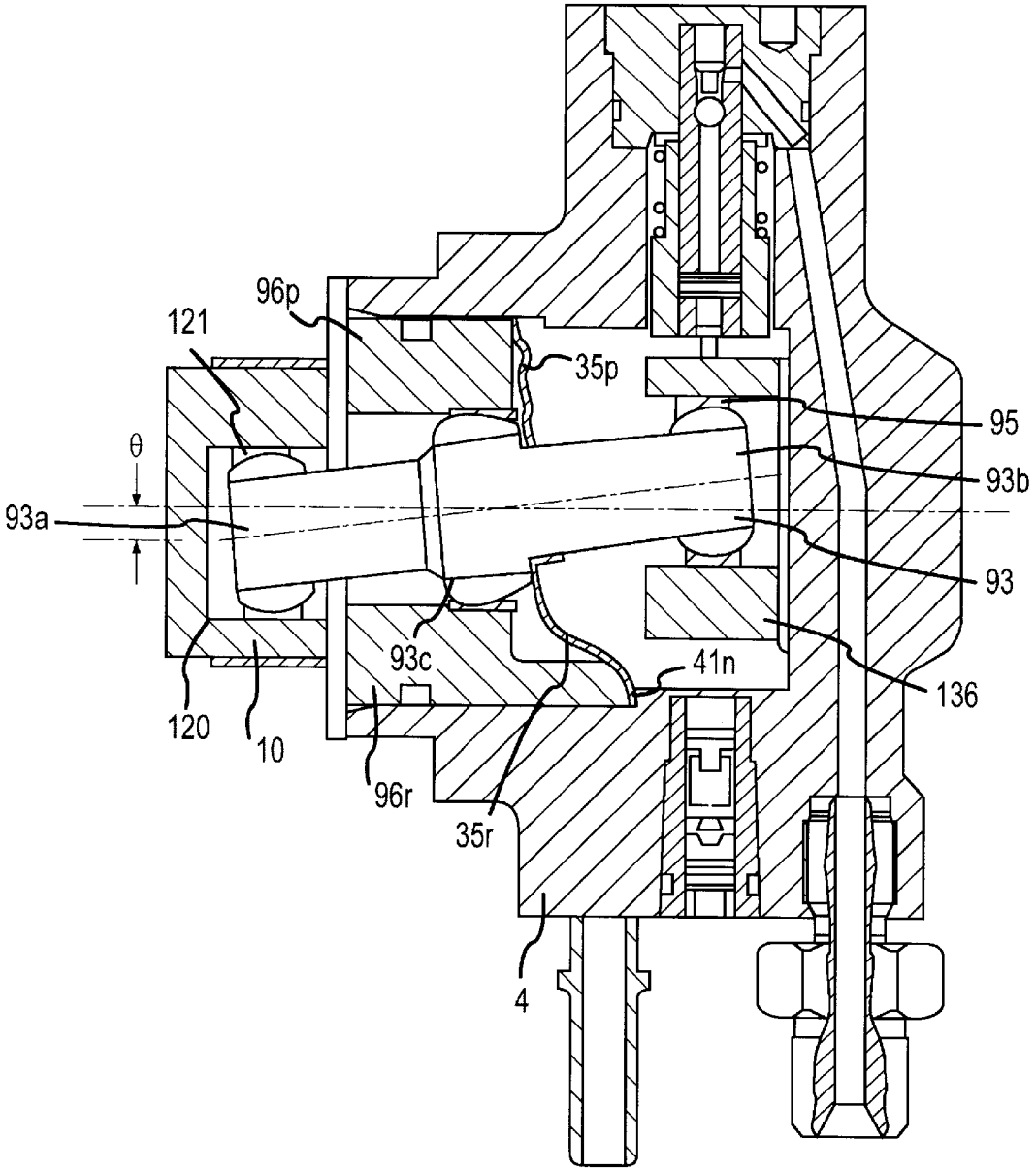
FIG. 6 is a section through a fifth illustrative embodiment of the radial-piston pump according to the invention.

FIG. 6 shows an alternative for the fourth illustrative embodiment in the form of a fifth illustrative embodiment. Here, the guide 94 from FIG. 5, which is fixed relative to the casing and is in engagement with an end portion of the coupling element 92, is replaced by a sealing and bearing portion 96 on a central, spherical portion 93*c* of a coupling element 93. The outer circumference of the sealing and bearing portion 96 is arranged in a fixed location by means of a sealing ring on the inner circumference of the casing pot 4.

One end portion 93*a* of the axially extending coupling element 93 is accommodated by means of an eccentric bearing 121, preferably a sliding-contact bearing, in the eccentric recess 120 of the eccentric shaft 10. That end portion 93*b* of the coupling element 93 which is remote from the end portion 93*a* in the axial direction is accommodated in the eccentric ring 136 by means of a bearing 95.

Adjacent to the central, spherical portion 93*c*, the flexible element 35 extends toward the sealing and bearing portion 96, on which a radially outer portion of the flexible element 35 is secured.

In one variant of this illustrative embodiment, the flexible element 35 is a metal diaphragm bellows 35*p*, shown in the upper portion of FIG. 6, with the result that there is very little sign of wear. Because of the high flexibility of the metal diaphragm bellows 35*p*, the sealing and bearing portion 96*p* can be of short configuration in the axial direction and can be secured in the casing pot 4 by means of the sealing ring on the outer circumference of the sealing and bearing portion 96*p*.

In another variant of this illustrative embodiment, said variant being shown in the lower portion of FIG. 6, the flexible element 35 is designed as a solid deformable diaphragm 35*r* which is pressed against a projection 4*m* in the casing pot 4 by the sealing and bearing portion 96*r*. The flexible element 35*r* thus also extends a certain distance in the axial direction, which allows well-balanced movement of the flexible element 35*r* with little stress to the material.

When the radial-piston pump is operated in accordance with the fifth illustrative embodiment, the coupling element 93 executes a tumbling movement within the envelope surface of a double cone.

Whereas, in the radial-piston pump in accordance with the fourth illustrative embodiment, half a rotation of the eccentric shaft 10 results in just one stroke of the eccentric ring amounting to less than the eccentricity e, the stroke of the eccentric ring in the case of half a rotation of the eccentric shaft 10 in the fifth illustrative embodiment can, in accordance with the principle of the lever, be smaller than or greater than the eccentricity e.

In the case of the radial-piston pumps in accordance with the third to fifth illustrative embodiments, it is advantageous if the coupling element is secured mechanically against rotation. This prevents a force in the rotational direction acting on the flexible element 35 and locations at which the latter is secured.

By means of the present invention it is thus possible to solve problems with sealing systems in gasoline pumps, such as those to do with wear and leaks, while, at the same time, it is possible for the pump drive in the lubricant zone to actuate the displacer in the working-fluid zone in the case of lubricant and working-fluid zones which are separated hermetically from one another.

According to the present invention, axially acting forces which are caused by differences in pressure in the working-fluid zone and the lubricant zone, the pressure of the working fluid generally being higher, can be absorbed by the casing of the radial-piston pump without impairing the ability of the pump to function.

This document thus discloses a radial-piston pump in which an eccentric shaft for driving a delivery unit is supported at one end in the pump casing and in which a shaft seal designed as a mechanical seal is arranged on the freely projecting end portion of the shaft. The slip ring rests against an eccentric ring of the eccentric shaft, said eccentric ring being pressed against the slip ring by a contact-pressure device and/or by the feed pressure of the medium to be delivered.

The eccentric ring is of cap-shaped design and reaches around the freely projecting end portion of the eccentric shaft. In modifications of this illustrative embodiment, there is a diaphragm between a sealing ring provided on the casing and a sealing portion on the eccentric, it being possible for said sealing portion to be provided in the form of a cap-shaped bush, optionally with a sliding-contact bearing, on an eccentric element or in the form of a coupling element in an eccentric recess of the eccentric shaft. A central portion or an end portion of the coupling element can be supported by the casing. In this arrangement, an end portion or a central portion thereof can bring about a stroke motion at a delivery element of the radial-piston pump.

The specification incorporates by reference the disclosure of German priority document 197 25 565.5 of Jun. 17, 1997 and International priority document PCT/DE98/01646 filed Jun. 17, 1998.

The present invention is, of course, in no way restricted to the specific disclosure of the specification and drawings, but also encompasses any modifications within the scope of the appended claims.

What is claimed is:

1. A radial-piston pump, comprising:

at least one delivery unit having a delivery element;

a pump casing having a first accommodation space for a medium to be delivered and a second accommodation space for a lubricant formed therein, said pump casing further having an eccentric side and a casing side;

a separating device separating said first accommodation space for the medium to be delivered and said second accommodation space for a lubricant from one another, said separating device including a first sealing element disposed fluid-tightly on said casing side of said pump casing and a second sealing element disposed on said eccentric side and connected fluid-tightly with said first sealing element;

a shaft bearing configuration disposed in said pump casing;

an input shaft having an end portion and supported by said shaft bearing configuration; and an eccentric element disposed on said end portion of said input shaft, said second sealing element disposed so as to be capable of sliding in a circumferential direction of said eccentric element, a rotary motion of said input shaft being convertible by said eccentric element into a radial motion of said delivery element of said delivery unit.

2. The radial-piston pump according to claim 1, wherein said separating device is configured such that an orbital motion can be provided between said first sealing element and said second sealing element.

3. The radial-piston pump according to claim 1, wherein said eccentric element is formed as an axial projection on said input shaft.

4. The radial-piston pump according to claim 3, wherein said first sealing element and said second sealing element have ends and are configured to slide upon one another at said ends.

5. The radial-piston pump according to claim 3, wherein said second sealing element is cap-shaped.

6. The radial-piston pump according to claim 5, wherein said second sealing element is a thin-walled component serving as one of a sliding-contact bearing and as an outer ring of a rolling-contact bearing.

7. The radial-piston pump according to claim 5, including a contact-pressure device preloading said second sealing element against said eccentric element, and said second sealing element has a base being acted upon by said contact-pressure device.

8. The radial-piston pump according to claim 1, wherein said eccentric element is an axial depression formed in said input shaft.

9. The radial-piston pump according to claim 8, wherein said second sealing element has a coupling element extending substantially in an axial direction, said coupling element transmitting motion from said input shaft to said delivery element and said coupling element has two end portions and a first of said two end portions disposed rotatably in said axial depression.

10. The radial-piston pump according to claim 9, wherein said coupling element is guided by said pump casing.

11. The radial-piston pump according to claim 10, wherein a second of said two end portions of said coupling element which is remote from said first of said two end portions of said coupling element which is disposed in said axial depression is disposed pivotably on said pump casing.

12. The radial-piston pump according to claim 10, wherein said coupling element has a portion between said two end portions disposed pivotably on said first sealing element.

13. The radial-piston pump according to claim 1, including a flexible element extending between said first sealing element and said second sealing element.

14. The radial-piston pump according to claim 13, wherein:

said eccentric element is an axial depression formed in said input shaft;

said second sealing element has a coupling element extending substantially in an axial direction, said coupling element transmitting motion from said input shaft to said delivery element and said coupling element has two end portions and a first of said two end portions disposed rotatably in said axial depression; and said flexible element is one of resting leak-tightly against said coupling element and secured to said coupling element.

15. The radial-piston pump according to claim 14, wherein said coupling element is secured mechanically against rotation.

* * * * *